US005130178A

United States Patent [19]

Zerfass et al.

[11] Patent Number: 5,130,178

[45] Date of Patent: Jul. 14, 1992

[54] SUPPORT WEB FOR ROOFING MEMBRANES

[75] Inventors: Karl-Christian Zerfass; Franz Kaulich, both of Bobingen; Michael Schöps, Grossaitingen; Hans Wagner, Bobingen; Bertrand C. Weiter, Augsburg, all of Fed. Rep. of Germany

[73] Assignee: Hoechst Aktiengesellschaft, Fed. Rep. of Germany

[21] Appl. No.: 667,888

[22] Filed: Mar. 12, 1991

[30] Foreign Application Priority Data

Mar. 14, 1990 [DE] Fed. Rep. of Germany ..... 4008043

[51] Int. Cl.[5] ..... B32B 11/02; D04H 3/14; D04H 3/16

[52] U.S. Cl. ..... 428/198; 156/62.4; 156/167; 156/181; 156/308.2; 428/141; 428/296; 428/297

[58] Field of Search ..... 156/62.4, 167, 181, 156/308.2; 428/198, 296, 297

[56] References Cited

FOREIGN PATENT DOCUMENTS 27750 4/1988 European Pat. Off. .
3425794 2/1987 Fed. Rep. of Germany .

*Primary Examiner*—James C. Cannon
*Attorney, Agent, or Firm*—Connolly & Hutz

[57] ABSTRACT

There is described a support web for roofing membranes which comprises a spunbonded made of polyester filaments. The spunbonded has a basis weight of from 50 to 100 g/m$^2$ coupled with a filament denier of from 1 to 8 dtex and has been consolidated with a fusible binder. This produces a high tear propagation resistance and nail pullout strength and also good dimensional stability at high temperatures. The spunbonded support web is therefore particularly suitable for bitumenized roofing membranes.

11 Claims, No Drawings

SUPPORT WEB FOR ROOFING MEMBRANES

The invention relates to a support web for roofing membranes and to a roofing membrane manufactured therewith.

Roofing membranes are, as will be known, fitted underneath the tiles or slate panels of steeply pitched roofs or the like as protection against airborne snow, dust and so on. Roofing membranes should on the one hand be water-impermeable but on the other air- and vapor-permeable. What is more, they should be very strong, in particular in terms of tear propagation strength, for example in order to be able to absorb the weight of a falling roofer.

A common type of roofing membrane is made of grid-reinforced films. It is true that these films have a high breaking strength: but their tear propagation resistance remains unsatisfactory, as is frequently their vapor permeability.

German Offenlegungsschrift 3,425,794 discloses a roofing membrane which is based on a polyurethane film covered with a spunbonded web material, made for example of polyester. The introduction to the description part of this Offenlegungsschrift mentions a membrane made of a spunbonded polyester web of high breaking strength which has been provided with a water-repellent and breathable special coating in the form of a paste. However, this publication does not reveal anything about the structure of the spunbonded polyester webs used.

European Patent Specification 0027750 describes a support web for a roofing membrane, which comprises a bonded fiber web of polypropylene, polyethylene, polyester or polyvinyl and has a basis weight between 85 and 200 g/m$^2$. To manufacture the roofing membrane, the fiber web is provided on one side with a layer of bitumen by coating the fiber web with warm bitumen and then cooling to create microvoids or microcracks. However, this publication too is silent on the structure of the fiber web, apart from mentioning the fiber material used and the basis weight.

It is an object of the present invention to create a support web for roofing membranes which ensures a high strength, in particular a high tear propagation resistance, of the roofing membrane and which possesses good dimensional stability even at high processing temperatures.

Starting from a support web for roofing membranes which comprises a spunbonded made of polyester, in particular polyethylene terephthalate filaments, this object is achieved according to the invention when the spunbonded has a basis weight of from 50 to 100 g/m$^2$ coupled with a filament denier of from 1 to 8 dtex and has been consolidated with a fusible binder.

As has been determined in trials, the structure of the spunbonded of the present invention confers good dimensional stability on the support web even at high processing temperatures. This is of importance for the manufacture of roofing membranes where the support web is bitumenized. In particular when the support web is being impregnated with bitumen the temperature is from 160° to 180° C. As has been found, the support web constructed according to the present invention exhibits good dimensional stability even at these high temperatures, which is of crucial importance for the processing of the support web. By contrast, support webs made of polypropylene, which softens at about 156° C., are for example less suitable for a bitumenization.

As mentioned, the support web for manufacturing a roofing membrane is preferably used in conjunction with bitumen. This preferably takes the form of impregnating the support web with bitumen; instead the support web can also be coated with bitumen, in which case it is preferably coated with bitumen on both sides.

The support web constructed according to the present invention has a tear propagation resistance of the order of from 20N to 80N, a nail pullout resistance of from 50N to 180N and a perforation stability of from 400N to 1200N, where the tear propagation resistance is determined in accordance with DIN 53356, the nail pullout resistance in accordance with UEATC and the perforation stability in accordance with DIN 54307.

Instead of bitumen, however, it is also possible to use another material with the spunbonded of the present invention, for example polyethylene or polyvinyl chloride.

The low basis weight of the spunbonded is advantageous in respect of the vapor permeability and for material savings. Preferably, the basis weight of the spunbonded is from 70 to 90 g/m$^2$.

The low denier of the filaments making up the spunbonded ensures good adhesion to the material bonded to the spunbonded, in particular bitumen, owing to the high specific area of the spunbonded. Preferably the filament denier of the spunbonded is from 2 to 5 dtex, in particular 4 dtex.

Suitable fusible binders are in particular polymers whose melting points are lower than the melting point of the load-carrying filaments forming the spunbonded.

Advantageously, the melting point of the fusible binder is 10° C., preferably 30° C., below the melting point of the load-carrying filaments.

Particularly suitable fusible binders are made of polyesters, preferably polybutylene terephthalate or modified polyesters having an appropriately reduced melting point, preferably modified polyethylene terephthalate.

The fusible binder is preferably introduced in fiber form. Consolidation is effected by a heat treatment of the web, in particular by means of calenders, which may possess smooth or profiled rolls, for example embossed rolls with an engraving. The process of consolidation may be effected by a calender alone or by means of a calender (preconsolidation) and a subsequent further heat treatment, for example by means of hot air or radiative energy.

The abovementioned fusible binders are particularly advantageously mixed into the web in the form of binder filaments in the course of the production of the web, i.e. as the future load-carrying filaments are being laid on the conveyor belt. In the course of a subsequent heat treatment, for example in a hot calender, the binder filaments melt in whole or in part and form the desired bonds at the crossing points of the load-carrying filaments.

The binder content is advantageously from 5 to 25% by weight, preferably from 10 to 15% by weight.

The following Example illustrates the invention:

The support web used was a spunbonded formed from polyethylene terephthalate filaments having a denier of 4 dtex and binder filaments made of a modified polyester in a proportion of 9%. The spunbonded was thermomechanically preconsolidated by embossed rolls and then endconsolidated with hot air. The basis weight of the support was 100 g/m$^2$. The support web was then bitumenized in a roofing membrane machine, coated on both sides with bitumen and sprinkled with sand. Here it showed excellent dimensional stability during the processing.

The roofing membrane manufactured in this way had the following properties:

| | | | |
|---|---|---|---|
| Sheet weight | 440 g/m$^2$ | according to | DIN 52 123 |
| Thickness | 0.60 mm | " | DIN 52 123 |
| Breaking strength | | | |
| along | 320 N/5 cm | " | DIN 52 123 |
| across | 300 N/5 cm | " | DIN 52 123 |
| Breaking extension | | | |
| along | 35% | " | DIN 52 123 |
| across | 45% | " | DIN 52 123 |
| Static perforation | Class L 4 | " | NF P 84-352 |
| Nail pullout resistance | 150N | " | UEATC |
| Tear propagation strength | | | |
| along | 50N | " | 53 356 |
| across | 50N | " | 53 356 |

We claim:

1. A support web for roofing membranes which comprises a spunbonded web of polyethylene terephthalate filaments, said spun-bonded web having a basis weight of from 50 to 100 g/m$^2$ coupled with a filament denier of from 1 to 8 dtex and having been consolidated with a fusible binder in the form of binder filaments.

2. The support web of claim 1, wherein the basis weight of the spunbonded web is from 70 to 90 g/m$^2$.

3. The support web of claim 1, wherein the filament denier of the spunbonded is from 2 to 5 dtex.

4. The support web of claim 1, wherein the fusible binder, filaments comprise a polymer having a melting point which is lower than the melting point of the polyethylene terephthalate load-carrying filaments.

5. The support web of claim 4, wherein the melting point of the fusible binder filaments is 10° C., preferably, 30° C., below the melting point of the polyethylene terephthalate load-carrying filaments.

6. The support web of claim 4, wherein the fusible binder filaments comprise polybutylene terephthalate or a modified polyester having an appropriately reduced melting point.

7. The support web of claim 1, wherein the content of binder filaments is from 5 to 25% by weight.

8. The support web of claim 4, wherein the content of binder filaments is from 10 to 15% by weight.

9. A roofing membrane comprising a support web as claimed in claim 1, wherein the support web has been impregnated or coated with bitumen.

10. A process for manufacturing the support web of claim 1 by combining a fusible binder fiber with the polyester filaments and consolidating the web by heat treatment.

11. The process of claim 10, wherein the consolidation is effected by means of a calender (preconsolidation) and subsequent further heat treatment.

* * * * *